United States Patent [19]

Peterson

[11] 4,260,293

[45] Apr. 7, 1981

[54] FLOATING DOCK STRUCTURE AND METHOD FOR FABRICATING THE SAME

[76] Inventor: John A. Peterson, 853 Apricot, Campbell, Calif. 95008

[21] Appl. No.: 140,495

[22] Filed: Apr. 15, 1980

[51] Int. Cl.[3] ..... E02B 3/20

[52] U.S. Cl. ..... 405/219; 405/221; 114/267; 52/802; 52/826; 52/263

[58] Field of Search ..... 405/219, 220, 221; 114/267; 52/802, 807, 813, 814, 821, 826, 824, 263

[56] References Cited

U.S. PATENT DOCUMENTS

| | | | |
|---|---|---|---|
| 2,597,786 | 5/1952 | Fontaine | 52/826 X |
| 2,605,866 | 8/1952 | Jernstrom | 52/802 |
| 3,131,542 | 5/1964 | Koch | 405/219 |
| 3,999,397 | 12/1976 | Albery | 52/263 X |
| 4,212,564 | 7/1980 | Kay | 405/218 |

FOREIGN PATENT DOCUMENTS

| | | | |
|---|---|---|---|
| 132694 | 5/1949 | Australia | 52/90 |

*Primary Examiner*—Dennis L. Taylor
*Attorney, Agent, or Firm*—Harry E. Aine; Harvey G. Lowhurst

[57] ABSTRACT

A floating dock having a steel framework to the underside of which are fastened buoyant flotation bodies and to the upper surface of which is fastened a rigid imperforate sheet such as plywood. The framework is constructed of a suitable number of C-shaped structural members each of which has a uniform cross section and a uniform hole pattern therein. The hole pattern is established so that members of different lengths can be assembled to form a dock structure of virtually any shape and size. All parts of the floating dock are dimensioned so that joints between various members are staggered to provide high strength and rigidity. A method for fabricating the floating dock structure which makes possible at least partial construction before the dock structure is placed in the water and also makes possible construction by persons of moderate skill using conventional hand tools.

12 Claims, 12 Drawing Figures

FLOATING DOCK STRUCTURE AND METHOD FOR FABRICATING THE SAME

BACKGROUND OF THE INVENTION

1. Field of the Invention

This invention relates to a floating dock and more particularly to a floating dock formed from a plurality of standardized components that can be rapidly assembled in a variety of shapes and sizes of dock structures.

2. Description of the Prior Art

Floating docks which are widely used in bodies of water are typically custom built for each specific installation. Custom building a dock is expensive in that there is frequently significant waste of material and fabrication must be performed by relatively highly skilled labor. Additionally, many known prior art floating docks are constructed predominantly of wood, which although relatively easy to work with, has limited longevity.

SUMMARY OF THE INVENTION

According to the present invention a generally rectangular framework is formed by a plurality of structural members that have a generally C-shaped cross section. Each of the structural members is formed with an identical uniformly repetitive hole pattern which permits the members to be quickly assembled in a large variety of shapes and sizes. By judicious selection of the specific lengths of members employed to form a given structure, the joints between the various members can be staggered to maximize the strength of the frame.

The frame or frames are supported by buoyancy bodies which are substantially coextensive with the rectangular frames or with segments thereof so that the frame is uniformly supported in the water and is therefore stable. Additional rigidity is achieved by securing to the top of the rectangular frames a rigid imperforate sheet such as a sheet of plywood or the like which forms a walkway surface of the dock structure.

The C-shaped structural members have a central web from opposite edges of which perpendicularly extend substantially identical flanges. A uniformly spaced row of holes is formed in each of the flanges, and gusset plates, having similarly spaced holes, are provided. By registering the gusset holes with the flange holes and introducing screw fasteners through the registered holes, the gussets are secured to the C-shaped members to retain the C-shaped members in rigid assembled form. Additionally, the gussets are apertured to facilitate attachment of the buoyant body to the frame.

The structure of the invention lends itself to assembly by persons of moderate skill and without the necessity of hoisting apparatus. The rectangular frames are constructed in accordance with the method of the invention in an upstanding orientation either on the shore adjacent the body of water in which the completed dock is to be placed or on a portion of the dock that has already been completed. The framework and the attachment of the buoyancy bodies can be completed with the framework in an upstanding position on the shoreline and final assembly can be rapidly completed after placement in the water.

The objects, features and advantages of the invention will be more apparent after referring to the following specification and the accompanying drawings.

DESCRIPTION OF THE PREFERRED EMBODIMENT

Figure 1:
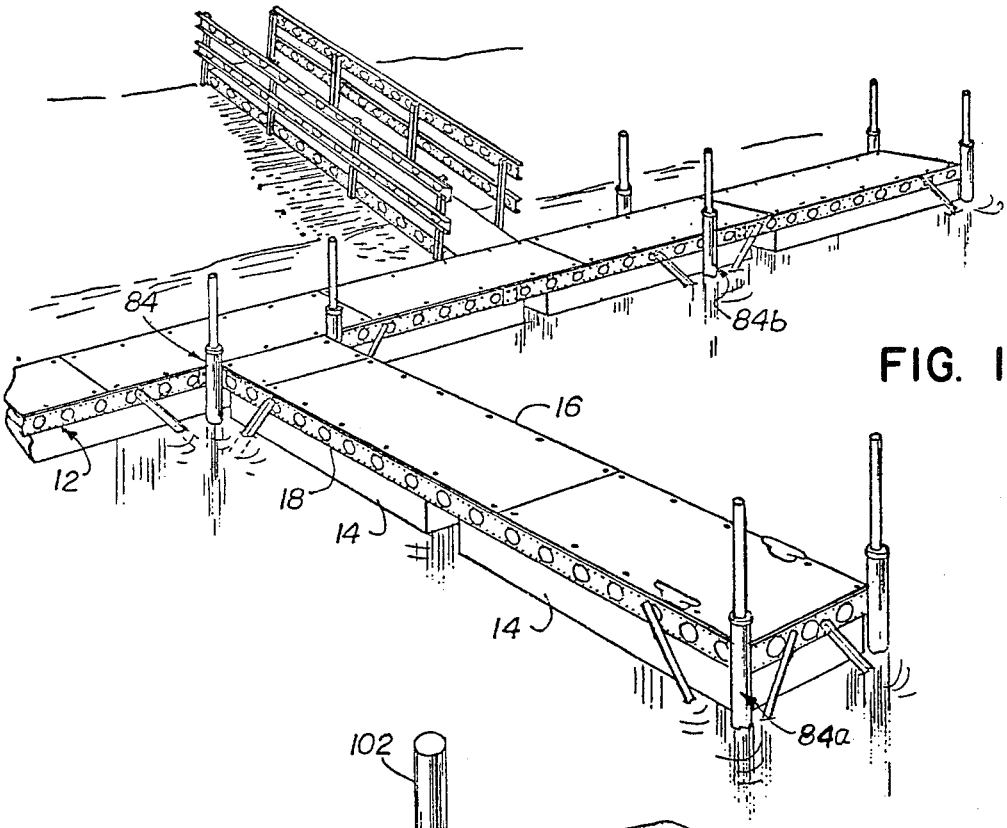
FIG. 1 is a fragmentary perspective view of one floating dock structure embodying the present invention.

Referring more particularly to the drawings and specifically to FIG. 1, a dock structure embodying the present invention has three principal components: a steel framework 12, a plurality of buoyant bodies 14 secured to the framework and affording flotation thereto, and a rigid impervious top sheet 16 which is secured to the upper surface of the steel frame to define a horizontal support surface or walkway. As will appear in more detail hereinafter, the above noted elements can be assembled in a variety of configurations to afford a floating dock of virtually any size or shape.

Figure 2:
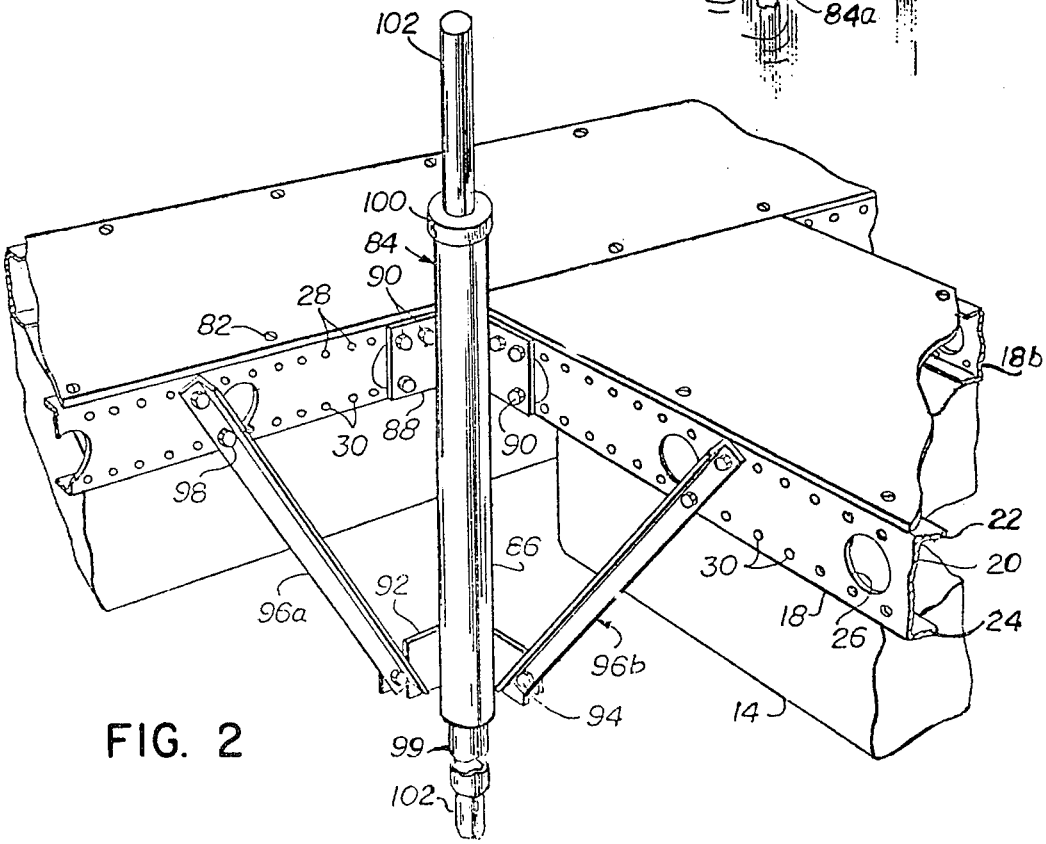
FIG. 2 is a perspective view at enlarged scale of a fragment of FIG. 1.

Steel framework 12 is fabricated from a plurality of structural members of generally C-shaped cross section, all of which have identical uniformly recurring hole patterns which facilitate assembly of the structural members into virtually any shaped frame. There are longitudinal structural members such as indicated in FIG. 2 at 18. Structural member 18 includes a central web 20 from opposite edges of which extend flanges 22 and 24. The flanges are equal in width and are perpendicular to web 20. Web 20 is formed with a hole pattern which is uniformly repetitive throughout the length of the structural member 18. The hole pattern is formed by relatively large diameter openings 26 which are spaced along the structural member at relatively long uniform intervals. In one system designed according to the present invention the interval between adjacent relatively large diameter holes 26 is 12 inches. Holes 26 are formed symmetrically of and midway between the opposite edges of web 20. Holes 26, in one system designed in accordance with the present invention, have a diameter of approximately 4 and 1/16 inches; formation of the holes reduces the overall weight of steel frame 12 without significantly impairing the strength thereof and, as will appear hereinafter, provides a path for utility and drainage lines.

Also formed in web 20 of structural member 18 is a first row of web holes 28 and a second row of web holes 30. The rows formed by web holes 28 and 30 are straight and are parallel to the respective edges of web 20. The rows are spaced symmetrically of the center line of the web. Holes 28 are uniformly spaced from one another, and holes 30 are uniformly spaced from one another by distances equal to the distance between adjacent holes 28. Individual holes 28 are transversely aligned with individual holes 30 so that member 18 is symmetrical about a center line through web 20.

Figure 8:
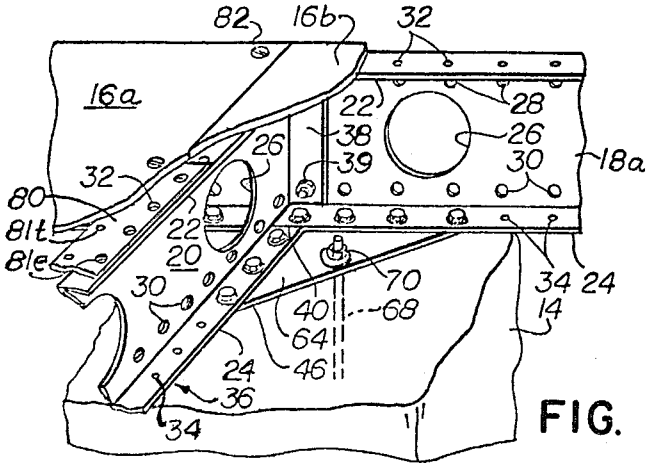
FIG. 8 is a fragmentary view of a portion of the structure of FIG. 5 at enlarged scale.

FIG. 8 shows a structural member 18*a* which is identical to structural member 18 in that it has a plurality of relatively large diameter holes 26 flanked by rows of web holes 28 and 30. As can be seen in FIG. 8, flange 22 has a row of flange holes 32 and flange 24 has a row of flange holes 34. Individual flange holes 32 and 34 are transversely aligned with web holes 28 and 30. Moreover, both rows of flange holes 32 and 34 are equidistantly spaced from the plane of web 20 so that structural members 18 and 18*a* are symmetrical of the center thereof.

In the previously mentioned specific system designed in accordance with the invention, longitudinal structural members 18, 18*a*, etc. are formed of 13 guage galvanized steel. Web 20 is about 8 inches wide, and flanges 22 and 24 are about 2 inches wide. Web holes 28 and 30 have a diameter of 25/64 inch to receive $\frac{3}{8}$ inch bolts therethrough. The web holes are formed on 2 inch centers. Flange holes 32 and 34 are substantially centrally located in their respective flanges and are formed on 2 inch centers. The flange holes have a diameter of 13/64 inch to provide engagement by $\frac{1}{4}$ inch self-tapping sheet metal screws. The longitudinal members 18 and 18*a* are typically provided in several standard lengths, such as 10 feet and 5 feet.

Figure 7:
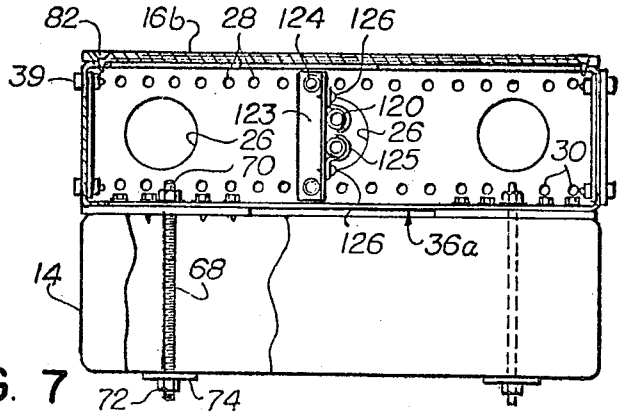
FIG. 7 is a cross-sectional view taken along line 7—7 of FIG. 5.

In forming frameworks 12 in accordance with the present invention, a pair of longitudinally extending structural members, such as 18 and 18*b* as seen in FIG. 2, are retained in spaced apart relationship by two or more transversely extending structural members, one such transverse structural member being indicated at 36 in FIG. 8 and another such transverse member 36*a* being seen in FIG. 7. The cross sectional shape and hole pattern present in the transverse structural members such as 36 and 36*a* are identical to that described previously. More specifically, the transverse members each have a planar web 20 from opposite edges of which extend perpendicular flanges 22 and 24. Web 20 has centrally located uniformly spaced apart relatively large diameter holes 26 and rows of web holes 28 and 30. Flanges 22 and 24 have respective rows of flange holes 32 and 34. At their opposite ends, transverse members 36 are provided with fastening plates 38 which are integral with web 20 and extend perpendicularly therefrom. Fastening plates 38 are provided with a pair of bolt holes that are disposed for registry with web holes 28 and 30. Accordingly, transverse members 36 and 36*a* can be secured to the side members by bolts 39 which extend through the holes in fastening plates 38 and a pair of transversely aligned web holes 28 and 30 in web 20 of side member 18*a*. Flanges 22 and 24 of the transverse members are foreshortened as at 40 so that the flanges of the transverse members are coplanar with the flanges of the longitudinal members when assembled as shown in FIG. 8.

Figure 5:
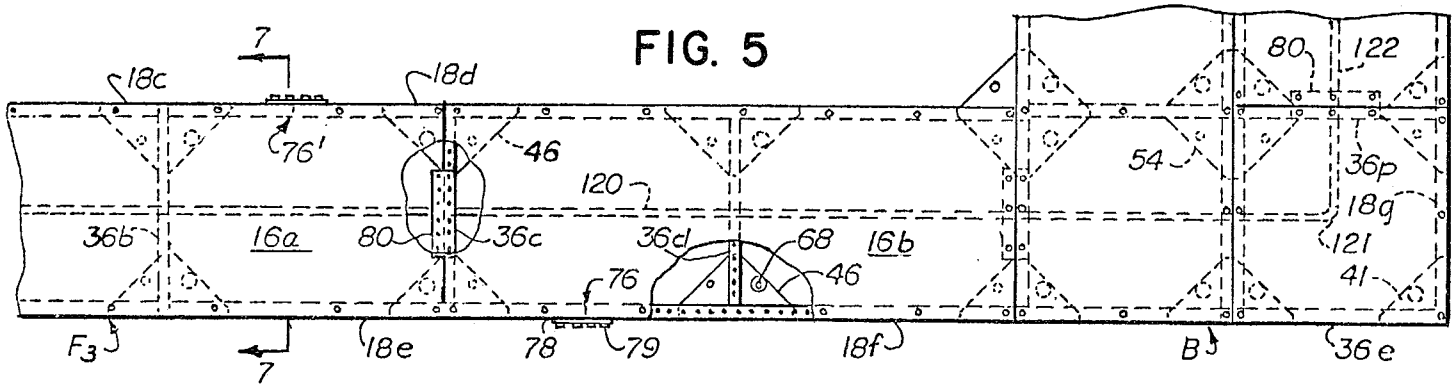
FIG. 5 is a plan view of a portion of the floating dock structure of FIG. 3, portions being broken away to reveal certain details.

As can be seen in FIG. 5, there is a dock finger $F_3$ having a plurality of transverse members which extend between the longitudinally extending side members. Such transverse members are identified at 36*b*, 36*c* and 36*d*. Finger $F_3$ also has longitudinally extending side frame members 18*c* and 18*d* at one side thereof and side members 18*e* and 18*f* at the other side thereof. Finger $F_3$ is attached to a base dock unit B; base unit B includes a transverse structural member 36*e* and a longitudinal structural member 18*g*.

The intersection of longitudinally extending structural member 18*g* and transverse frame member 36*e* seen in FIG. 5 exemplifies a detail of the invention in that the intersection is reinforced by a quarter gusset plate 41. A quarter gusset plate is also shown in somewhat more detail in FIG. 9. Gusset plate 41 is of generally right triangular shape and has a row of mounting holes 42 along one leg and a row of mounting holes 44 along the other leg, the rows being mutually perpendicular. Individual holes 42 and 44 are spaced from one another by an amount corresponding to the spacing between holes 34 in flange 24 so that when the gusset is in place as seen in the lower left-hand corner of FIG. 9, holes 42 and 44 will align with holes 34 in the flanges of two mutually perpendicular structural members.

Figure 9:
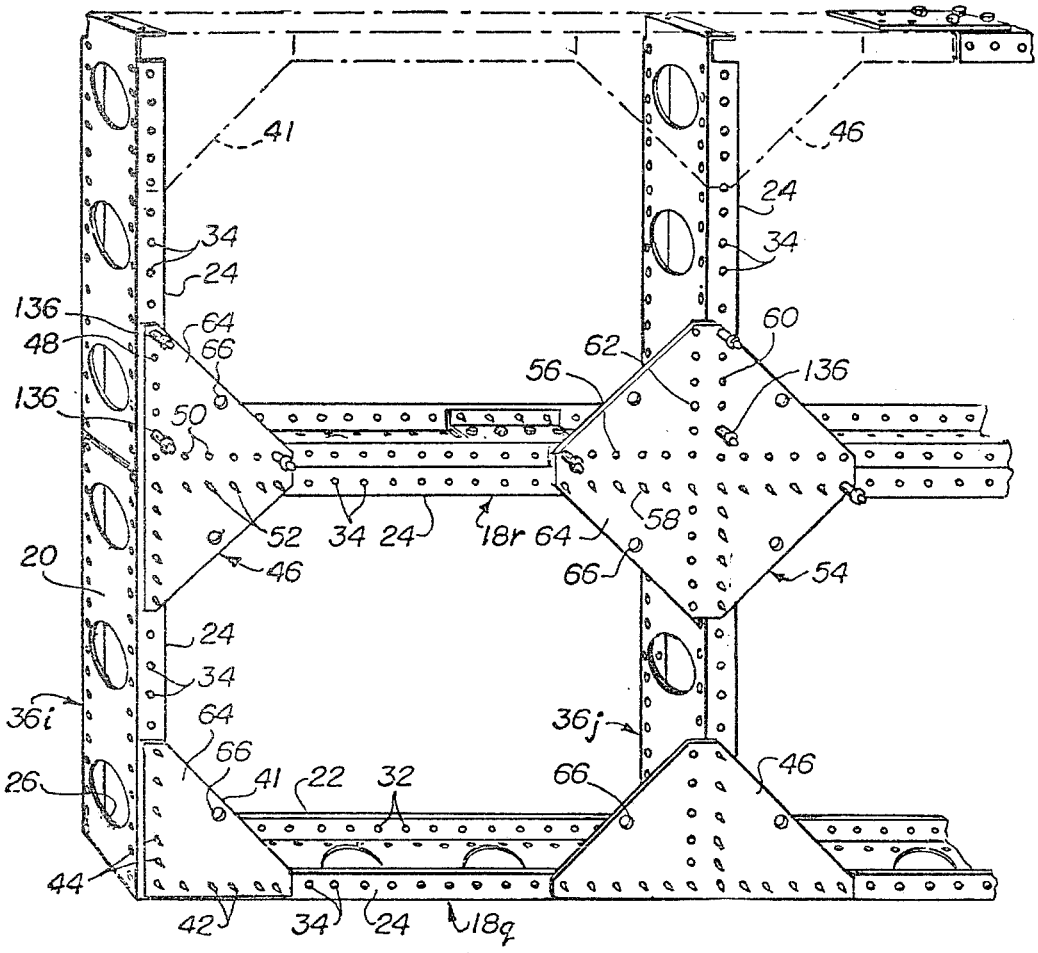
FIG. 9 is a perspective view of an exemplary frame structure of the invention during an intermediate stage in the assembly thereof.

There is also a half gusset employed in the dock structure of the invention, such half gusset being indicated at 46 in FIGS. 5 and 9. Half gusset 46 includes a row of holes 48 which correspond in spacing to holes 34 in flange 24. Extending perpendicular to the row of holes 48 are two rows of holes 50 and 52. Holes 50 and 52 are spaced from one another in their respective rows by an amount corresponding to the spacing between holes 34 in flange 24; holes 50 and 52 are spaced transversely of one another by an amount corresponding to the space between two transversely aligned flange holes 34 when two C-shaped members are installed in face-to-face relationship as indicated in FIG. 9.

Finally there is a full gusset 54 of generally diamond shape shown in FIG. 9. Full gusset 54 includes two parallel rows of holes 56 and 58 and two parallel rows of holes 60 and 62, the latter rows being perpendicular to the former rows of holes. The individual holes in each row are spaced from one another by an amount corresponding to the spacing between holes 34 in flanges 24, and parallel rows are spaced from one another by an amount corresponding to the space between two transversely aligned flange holes 34 when two C-shaped members are installed in face-to-face relationship as indicated in FIG. 9. In the exemplary system designed in accordance with the invention that has been referred to previously, the gusset holes and flange holes are disposed on two inch centers, and the parallel rows of gusset holes are spaced apart by two inches to register with the flange holes in two members installed in a face-to-face relationship.

It will be appreciated that half gusset 46 and quarter gusset 41 can be fabricated from a full gusset 54 by shearing the full gusset at appropriate locations. It will be further appreciated that quarter gusset 41 is employed at corners of a dock structure, that half gusset 46 is employed where a transverse member perpendicularly intersects a side member and that full gusset 54 is employed where members intersect, all three examples being shown in FIG. 5. Self tapping screws are installed through flange holes 34 and the holes in the gussets in sufficient number to retain the gussets in place and secure the C-shaped members in rigid perpendicular relationship to one another.

As can be seen most clearly in FIG. 9, each gusset plate 41, 46 and 54 includes an obliquely extending marginal portion 64 in which a hole 66 is formed. Hole 66 functions to receive one end of a rod 68 (see FIG. 8) which extends through buoyant body 14 and exemplifies a buoyant body attaching means. Rod 68 has a fastener, such as a nut 70, threaded to the portion thereof that extends above marginal portion 64 of the gusset and a fastener, such as a nut 72, on the lower end thereof that protrudes below the buoyant body. As can be seen in FIG. 7 there is a large washer 74 between nut 72 and the lower surface of the buoyant body, washer 74 preferably being formed from the material punched out during formation of holes 26. Such material, having a relatively large diameter, serves well as washer 74 because it has a sufficient surface area to spread force over a large portion of the lower surface of buoyant body 14. The presence of a gusset 41, 46, or 54 at each intersection of the C-shaped structural members that form steel framework 12 and the presence of at least one mounting hole 66 in each such gusset assures adequate attachment of buoyant bodies 14 to the frame.

Figure 6:
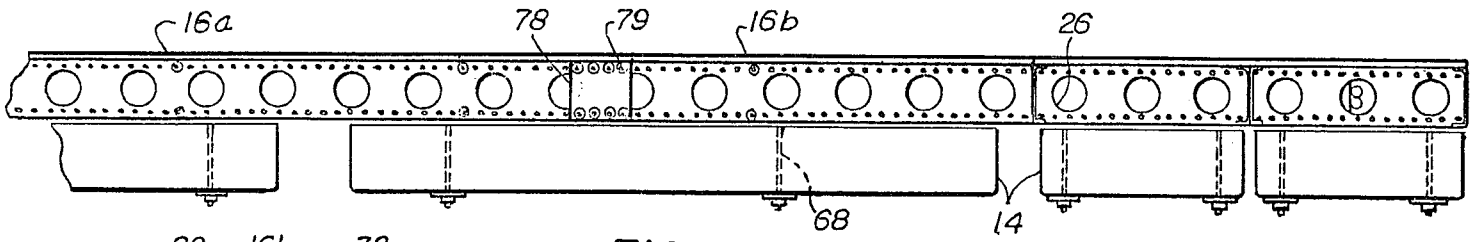
FIG. 6 is an elevation view of the dock structure of FIG. 5.

Referring to FIGS. 5 and 6, side member **18*e* and side member 18*f* butt against one another at a joint 76. Joint 76 is formed by a splice plate 78 which has two parallel rows of holes which are positioned to register with holes 28 and 30 in the webs of the respective side members. As can be seen in FIG. 6, there are four upper holes and four lower holes in the splice plate, and threaded fasteners or bolts 79** are passed through such holes and the registered holes in the webs of the side members to retain the side members in immovable abutting relation.

It can be seen in FIG. 5 that there is a joint 76' between side members **18*c* and 18*d*. It will be noted that the latter joint and the splice plate employed in forming it are offset longitudinally of the joint 76 between side members 18*e* and 18*f***, a characteristic that imparts improved rigidity to the assembled framework.

Also imparting rigidity to the framework and forming a load supporting surface or walkway for the floating dock are rigid imperforate sheets of plywood or the like, there being sheets **16*a* and 16*b* in FIGS. 5 and 6. The plywood sheets, which can be plywood with a skid resistant top surface, have a length different from the length of the side members 18 so that the joints in the plywood are offset from the joints 76 and 76' between adjacent side members. More particularly, sheet 16*b* has a length of 8 feet so that the plywood reinforces joint 76 and has its longitudinal extremity spaced from joint 76'. Sheet 16*a* has a similar length and serves to reinforce joint 76'. Referring to FIG. 7, the sheets are retained to the steel framework by flathead screws 82 which extend through the plywood sheet and engage flange holes 32 in flange 22** of the side members. Thus when the dock structure is assembled all major components thereof, the steel framework, the buoyant bodies and the rigid impervious sheet, coact to form a rigid structure.

At the joints between adjacent plywood sheets **16*a* and 16*b* there is a flooring splice plate 80 that has a length less than the length of transverse members 36 and a width approximately twice that of flanges 22 and 24. The flooring splice plate has a row of clearance holes 81*c* and a row of smaller thread engaging holes 81*t* which are spaced at intervals corresponding to the spacing between the flange holes 32 and 34. Thus, as seen in FIG. 5 at a joint between plywood sheets 16*a* and 16*b*, the flooring splice plate is installed and retained in place by at least one screw 82 passed through sheet 16*b* and clearance hole 81*c* and is threadedly engaged with flange hole 32 of transverse member 36. One or more screws can be installed through plywood sheet 16*a* for threaded engagement with one or more of holes 81*t* in the flooring support plate. Because the thickness of flooring splice plate 80** is slight, no significant bulge in the flooring will be created at joints where such plate is installed.

One suitable structure for anchoring the dock structure in place in the water is indicated generally at 84 in FIG. 1. Referring to FIG. 2, anchoring structure 84 includes a cylindric tube 86 to which is attached by welding or the like a right angle upper mounting plate 88. Mounting plate 88 has upper and lower rows of holes that register with web holes 28 and 30 in side members 18 so as to permit installation of threaded fasteners or bolts 90 to secure the plate and the upper portion of tube 86 to the floating dock structure. Below upper mounting plate 88 is a lower mounting plate 92 also rigidly fixed to tube 86. The free ends of mounting plate 92 form holes to receive threaded fasteners 94 which secure the lower ends of angle braces **96*a* and 96*b* to the lower mounting plate. The upper end of each brace 96*a* and 96*b* has a pair of holes which are spaced from one another by an amount greater than the transverse distance between web holes 28 and 30 in side member 18 so that threaded fasteners 98 can pass through the holes in the braces and in web holes 28 and 30 to secure the braces to the side member. More specifically, it is preferable that all parts are dimensioned so that braces 96*a* and 96*b* reside at an angle of 45° to tube 86. Thus the distance between the holes in the upper end of the braces is preferably equal to $\sqrt{2}$ times the transverse distance between web holes 28 and 30. In one structure designed in accordance with the invention, the transverse distance between holes 28 and 30 is 6 inches and the distance between the two holes at the upper ends of braces 96*a* and 96*b* is equal to about 8 and ½ inches. The diameter of the holes in the braces is sufficient that alignment can be achieved and firm attachment of the upper ends of the braces effected. Telescoped within tube 86 is a pipe 99 which has a flange or bushing 100 fixed to the upper end thereof to prevent the pipe from escaping from the tube. Pipe 99 has a length substantially greater than that of tube 86. Within pipe 99 is installed a rod or pipe 102 which is driven into the bottom beneath the body of water in which the dock structure is floated. In one exemplary system designed according to the present invention, tube 86 is constituted by a 5 inch diameter pipe of 5 feet length, pipe 99 is constituted by a 4 inch diameter pipe of 14 feet length, and rod 102** is constituted by a 3 inch diameter pipe of 20–26 feet in length.

In FIG. 1 there are several alternate forms of anchoring structure, one being indicated at **84*a* and adapted for mounting on outside corners of the dock structure and another 84*b* being adapted for mounting on straight portions of the dock structure. Anchor assemblies 84*a* and 84*b* are similar to anchoring structure 84** except that the mounting plates therefor are shaped appropriately for the location of installation.

Figure 3:
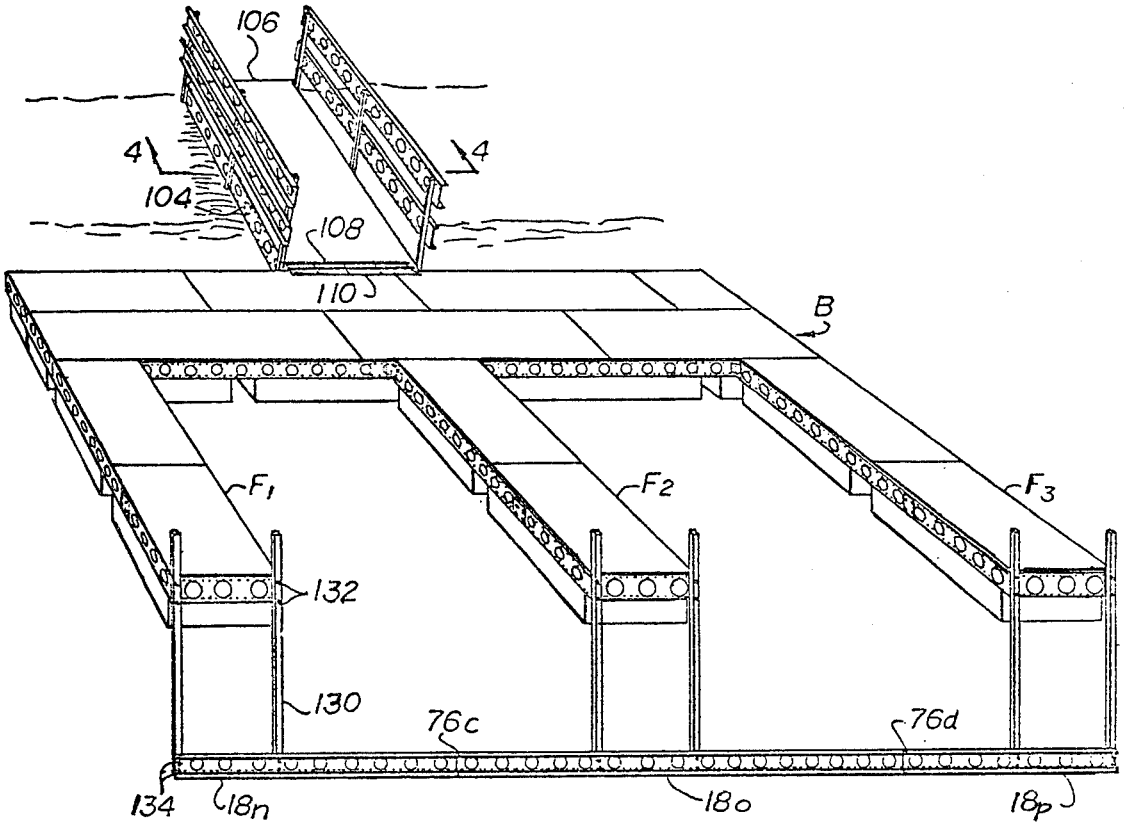
FIG. 3 is a perspective view of another floating dock structure embodying the invention.
Figure 4:
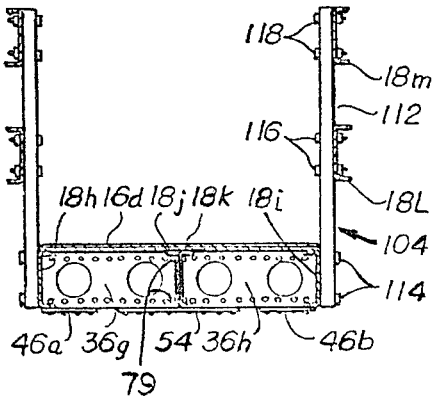
FIG. 4 is a sectional view taken along line 4—4 of FIG. 3.
Figure 10:
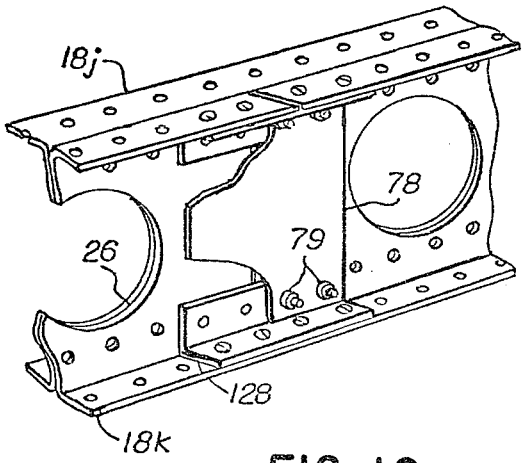
FIG. 10 is an enlarged view of a joint in the structural members constituting a part of the invention.

Structural members formed in accordance with the present invention can also be adapted to form a bridge assembly 104 (see FIG. 3) to afford access from the shoreline to the dock structure. Bridge 104 has an upper end 106 which is supported on the land adjacent the body of water in which the dock structure is floated and a lower end 108 which is supported on the floating dock structure. End 108 can be joined by means of a hinge 110 to afford pivotal movement between the bridge and the dock structure as the dock structure is raised and lowered as a result of changing water levels or tides. Having reference to FIG. 4, the dock structure has U-shaped side structural members 18*h* and 18*i* and central U-shaped members 18*j* and 18*k* which, as seen in FIGS. 4 and 10, are fastened to one another in face-to-face relationship by bolts 79 that extend through web holes 28 and 30. Also seen in FIG. 4 are transverse members 36*g* and 36*h* which are joined to the respective longitudinally extending side members in the manner described previously. The bridge also includes quarter gussets 41, half gussets 46*a* and 46*b* and full gussets 54. Finally, the bridge has an impervious top sheet such as indicated at 16*d* secured to the top flanges of the side members and transverse members by flathead screws as indicated previously to provide a rigid structure. In the specific embodiment shown in FIG. 4, transverse members 36*g* and 36*h* each have a length of 2 feet and top sheet has a width of 4 feet, whereby all elements coact to form an extremely strong bridge.

Contributing to the rigidity of the bridge assembly 104 and providing side rails therefor are vertically extending members 112 to which are mounted horizontally extending C-shaped structural members 18L and 18*m*. The C-shaped members are identical to those described previously. Vertically extending members 112 have three pairs of holes formed therein, the holes of each pair being spaced from one another by an amount corresponding to the distance between web holes 28 and 30. Thus the lower end of the vertically extending member 112 is secured to horizontal side member 18*i* by bolts 114, to C-shaped member 18L by bolts 116 and to C-shaped member 18*m* by bolts 118. The C-shaped members 18L and 18*m* impart rigidity to bridge 104 and form a handrail for the bridge. In one structure designed in accordance with the invention, vertical members 112 are formed of square 2 inch steel tubing. Because the side rail on the other side of bridge assembly 104 is constructed substantially indentically to that described above, no further description of the same is needed.

In fabricating a bridge structure of the type shown in FIG. 4 it is desirable that all joints formed between abutting longitudinally extending C-shaped members be staggered from one another, including the joints in members 18*m* and 18*L* in the side rails. In addition the joints are desirably reinforced by splice plates 78 and reinforcing brackets 128 (see FIG. 10). By staggering the joints and reinforcing them, a bridge of substantial length can be fabricated by use of the same parts as are used in fabricating the framework for the floating dock structure.

Face-to-face C-shaped members 18*j* and 18*k* in the bridge shown in FIG. 4 can be dispensed with for three foot wide bridges of shorter spans. However, in such narrower bridges it is important to include members such as 18*m* and 18*L* in the side rail to provide additional strength to the bridge and stagger the joints in the longitudinally extending C-shaped members.

In many dock structures it is desirable to have water and/or electric connections accessible at outer edges of the dock members. Because the side members and transverse members of the invention have uniformly spaced openings 26, the openings in the members are aligned when assembled into a frame. For example, in FIG. 5 there is a utility line run 120 (such as a pipe or conduit) which resides below sheets 16*a* and 16*b* and extends through the central openings 26 in transverse members 36*b*, 36*c*, and 36*d*. There is a 90° bend 121 positioned in base unit B so that a run 122, perpendicular to line run 120, extends through holes 26 in the transverse frame members, such as 36p which is a part of base unit B. The utility line 20 is secured to the frame members by means of a structure shown in FIG. 7. There is a utility bracket 123 which is formed by an angle iron having two mutually perpendicular plates. One plate has upper and lower holes that are spaced from one another by a distance equal to the space between web holes 28 and 30 so that the bracket can be secured to the web of transverse member 36*a* by means of bolts 124. The other plate of bracket 123 forms a pair of holes adjacent the perimeter of holes 26 so that conduit or pipe clamps 125 can be secured to the bracket by self tapping screws 126. Thus utility line 120 can be securely installed in the dock structure at any convenient location by the installation of utility brackets 123 adjacent aligned holes 26 in the C-shaped structural members that form the framework for the dock structure.

FIG. 10 shows a joint reinforcing bracket 128. Bracket 128 is formed by two mutually perpendicular plates, each of which defines a row of holes spaced from one another by the same distance that the flange holes and the web holes are spaced from one another. Accordingly, screws and/or bolts can be passed through the registered holes in the reinforcing bracket and in the C-shaped members to span a joint and reinforce it. Additionally, reinforcing bracket 128 can be installed in spanning relation to hole 26 as is the case with utility bracket 123 shown in FIG. 7. Because in the preferred embodiment of the invention, the space between web holes 28 and 30 is equal to 6 inches and because the holes in the plates of reinforcing bracket 128 are four in number and are formed on two inch centers, bracket 128 can be employed to support utility and drainage lines.

FIG. 10 also discloses inclusion of a splice plate 78 in combination with reinforcing brackets 128. The bolts holes in the splice plate line up with the holes in the reinforcing brackets and with the web holes in the ends of the C-shaped structural members so that only eight bolts 79 are needed to complete a very strong joint. It will be noted in FIG. 10 that the joint there disclosed is spanned by C-shaped member 18*j*, a factor further contributing to the strength of the joint.

The C-shaped side members are also useful for providing support between two or more parallel extending fingers in a dock structure. Referring to FIG. 3, there are three dock fingers indicated at $F_1$, $F_2$ and $F_3$ which extend perpendicularly from a base unit B. At the ends of the fingers remote from base unit B are vertically extending members 130 which can be square tubular 2 ×2 steel members. At their upper ends, members 130 have two bolt holes which are spaced from one another by a distance equal to the spacing between web holes 28 and 30 so that the members 130 can be secured to the frames forming part of the fingers by bolts 132. The lower ends of vertical members 130 have an identically spaced pair of holes so that elongate C-shaped members 18*n*, 18*0* and 18*p* can be mounted by means of bolts 134. The length of vertical members 130 is such that the elongate 18*n*, 18*o* and 18*p* are sufficiently below the surface of the water to avoid interference with boats entering the space between adjacent fingers. Splices between abutting longitudinal members include splice plates 76c and 76d and reinforcing brackets 128 so that a rigid structure is provided.

Figure 11:
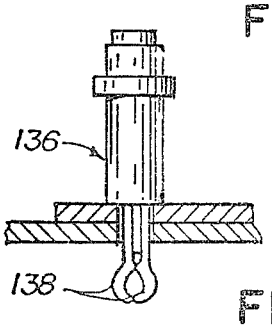
FIG. 11 is a view of a temporary fastener employed in fabricating the frame of FIG. 9 in a retracted position.
Figure 12:
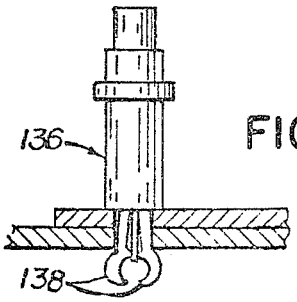
FIG. 12 is a view of the fastener of FIG. 11 in an expanded position.

The method for assemblying the parts described hereinabove in fabricating a dock structure will be described in connection with FIGS. 9, 11 and 12. In fabricating the framework shown in FIG. 9, an elongate C-shaped side memger 18q is placed on a horizontal surface as near the body of water in which the dock structure is to be installed as is possible. In cases where a portion of the dock structure has already been assembled and placed in the water, subsequent frameworks can be constructed on top of the dock structure previously assembled and installed. Next a quarter gusset 41 is temporarily secured to the end of member 18q by means of two or more "Cleco" fasteners, such fasteners being conventional elements and being identified at 136 in FIGS. 11 and 12. The Cleco fasteners include an internally disposed spring (not shown) which retains two extending fingers 138 in an expanded or spread apart position, shown in FIG. 12. By use of a special tool, the fingers can be moved axially outward until they assume a radially retracted position indicated in FIG. 11. When the Cleco fasteners 136 are moved to the radially retracted position they can be inserted through the holes 42 in the gusset plates and the holes 34 in flange 24 of member 18q and then released to support temporarily the gussets onto the C-shaped member. A transverse member 36a is placed on member 18q and temporarily retained by Cleco fasteners installed through the gusset holes and the flange holes. At this time, bolts 39 (as in FIGS. 7 and 8) can be loosely installed. A transverse member 36j and a gusset 46 are installed in a similar manner at a suitable distance (e.g., 4 feet) from transverse member 36i. Next, an elongate C-shaped member 18r is installed on the upper ends of transverse member 36a and 36j and is retained temporarily by means of a half gusset 46 and a full gusset 54 and a suitable number of Cleco fasteners 136. The entire framework is constructed in this manner; such construction can be achieved very rapidly because all holes in the various parts are formed to align with one another. When the structure has been partially or temporarily assembled, screws are used to affix permanently the gussets to the flanges of the respective members. The screws are preferably self-tapping sheet metal screws so that they can be installed very quickly with power equipment. The screws are installed with their heads at the interior surface of flanges (see FIG. 8) so that they can be conveniently removed, if such should be necessary, after the dock structure is placed in a horizontal position in the water. After the screws are in place the Cleco fasteners can be quickly removed for subsequent use. After all gussets are securely fastened with self-tapping screws, bolts 39 are tightened.

While the framework is in the upstanding position shown in FIG. 9, the buoyant bodies 14 are attached. Fasteners 70 and 72 as well as washer 74 which are used in conjunction with rods 68 can be readily manipulated because the ends of the rod and the fasteners are easily accessible. After the buoyant bodies have been attached, the framework can be moved to a horizontal position, either on a ground surface or in the water.

To recapitulate the preferred sequence of steps in fabricating a frame according to the present invention, the joints between the horizontally extending member 18q and the upstanding transverse members are formed by temporarily retaining the gussets and the transverse members in place by several Cleco fasteners at each joint. Next, bolts 39 are installed loosely, after which self-tapping screws are installed through registered flange holes and gusset holes. The Cleco fasteners are then removed and bolts 39 are tightened. Next the buoyant bodies 14 are installed. Finally, the assembled structure is moved to a horizontal position in the water.

When the frame has been completed it is placed in the water and secured to other portions of the frame that may have been installed previously. Then sheets 16 are installed. The sheets are installed from above so tht screws 82 can be inserted very rapidly with hand or power equipment. Sheets 16 are predrilled at multiples of the spacing of flange holes 32 to expedite installation of screws 82.

In those cases where utility lines such as line 120 are to be installed, the utility lines are installed before installation of impervious panels 16. Because of the manner of attachment of utility clamps 123, the clamps can be readily installed at any time before the impervious sheets are installed. In the type of dock structure shown in FIG. 3, the brace assembly formed by elongate members 18n, 18o and 18p together with splices 76c and 76d and vertical members 130 is fabricated on the previously completed and installed dock structure. When such brace assembly is completed the entire brace structure is lowered into place and bolts 132 are engaged to complete such installation. Bolts 132 can be installed before the impervious sheets are installed or, alternatively, can be installed after installation of the impervious sheets. The latter order of installation is possible because access to the interior end of bolts 132 can be had through holes 26. In dock structures having a length greater than that shown in FIG. 3 the braces can be fabricated and installed in parts so that each part has a size and weight that can be conveniently handled. When the braces are installed in parts, minimal underwater work suffices to complete all splices.

Although members 18n, 18o and 18p as seen in FIG. 3 form a single brace, it will be apparent that a second row of members can be installed in parallel with members 18n, 18o and 18p and on the opposite side of vertical members 130. The strength of a two row brace is substantial and can be enhanced by bolting spacers formed of the same material as vertical members 130 between the rows at one or more locations between the dock fingers.

The dimensional relationships between the parts of the floating dock structures described hereinabove are selected to achieve synergy when the parts are assembled. For example, the longitudinally extending side frame members 18 are typically 10 feet in length, and the plywood sheets 16 are typically 8 feet in length. This dimensional relationship together with the fact that splices 76 between adjacent side frame members 18 are staggered assures a high strength dock assembly. Additionally, the buoyant bodies 14 are preferably 9 feet in length and contribute to the rigidity of the assembled dock structure. Finally, the typical transverse member 36 has a length (e.g., 3 feet) equal to the width of the buoyant bodies so that the dock structure is highly resistant to tipping. Also contributing to the resistance to tipping is the fact that the buoyant bodies 14 are formed of expanded polystyrene or like material of uniform density so that the buoyant force provided by buoyant bodies 14 is uniform throughout the extent of the dock structure of which they are a part. Moreover, the presence of braces or trusses such as those formed by members 18n, 18o and 18p significantly improves resistance to tipping due to unbalanced loads imposed on one of the dock fingers.

Because the transverse distance between web holes 28 and 30 is equal to an integral multiple of the space between adjacent web holes in each of the rows of web holes, C-shaped members can be mounted vertically at the edge of an installed section thereby to provide scaffolding or hoist supports to facilitate construction and/or use of the dock. Accordingly, the uniform hole pattern in all members affords substantial versatility in both designing and constructing floating docks in accordance with the invention.

Thus it will be seen that the present invention provides a floating dock structure which can be assembled in one of a large number of configurations and in which the assembly can be achieved rapidly and accurately by persons of moderate skill. Such is the case because the hole pattern in the members is repetitive so that the holes in one part align with the holes in all other parts. Although several embodiments of the invention have been shown and described, it will be obvious that other adaptations and modifications can be made without departing from the true spirit and scope of the invention.

What is claimed is:

1. In a dock structure:

a walkway to be supported above the surface of a body of water, said walking including a plurality of rigid structural members each having a generally C-shaped cross sectional shape formed by a web having two parallel edges and flanges extending from respective said edges in perpendicular integral relation to said web, said web having first and second rows of web holes therein, said rows being disposed on opposite sides of the center line of said web in symmetry of the center line, the web holes in each said row being disposed at uniform intervals and the web holes in said first row being transversely aligned with web holes in said second row, said flanges each having a row of flange holes therein, said flange rows being uniformly spaced from said web edges, the flange holes being uniformly spaced apart along said rows and the flange holes in one said row being transversely aligned with the flange holes in the other said row, said structural members being assembled in a rectangular configuration to form a rectangular frame, there being at least first and second said structural members disposed in parallel spaced apart relation and constituting side members and at least two structural said members extending between said side members in perpendicular relation thereto and constituting transverse members, the webs of said transverse members having at the ends thereof integral fastening plates which extend perpendicularly of said webs and having plate holes disposed for registry with said web holes in said side member, a plurality of fasteners extending through said plate holes and said web holes in said side members for joining said side members and said transverse members in rectangular configuration, a gusset plate for reinforcing the intersection of said transverse member with said side member, said gusset plate having first and second mutually perpendicular rows of gusset holes that are spaced at intervals for registry with said flange holes in adjacent said structural members, a plurality of gusset fasteners extending through said gusset holes and said flange holes for joining said gussets to said flanges, and a rigid sheet secured to said rectangular frame remote from said gussets to form a walkway surface.

2. The structure of claim 1 including a buoyant body and means for securing said buoyant body to said rectangular frame.

3. The dock structure according to claim 2 wherein said buoyant body securing means includes a portion of said gusset plate remote from said rows of screw holes defining a mounting hole, a rod extending through said mounting holes and said buoyant body, and means engaged on the upper and lower extremities of said rod for retaining said buoyant body on said gusset.

4. The dock structure according to claim 1 including a plurality of large diameter holes formed in the webs of said structural members, said large diameter holes being uniformly spaced along said web intermediate said first and second rows of web holes and being symmetrical of the center line of said web.

5. The dock structure according to claim 4 including a utility bracket having first and second mutually perpendicular integral plates, said first plate having a pair of fastener holes therein that are spaced apart by an amount equal to the spacing between said first and second web holes, said second plate having clamp holes therein disposed from one another by an amount greater than the diameter of said large diameter holes, means extending through the holes in said first place and the web holes for mounting said utility bracket in spanning relation of said large diameter hole so that utility lines extending through said large diameter hole can be clamped to said second plate by means of said clamp holes.

6. The dock structure according to claim 1 in combination with a pair of generally C-shaped cross sectional members constituting central members and disposed between said side members, means extending through the web holes in said central members for retaining the webs thereof in face-to-face relationship with the flanges of respective said central members extending outward, there being first transverse members extending between one side member and one central member and second transverse members extending between the other side member and the other central member.

7. The dock structure according to claim 1 in combination with third and fourth structural members substantially identical to said first and second structural members, first splicing means for forming a butt joint between said first and third structural members and second splicing means for forming a butt joint between said second and fourth structural members, said splicing means being longitudinally offset from one another, said rigid sheet spanning said splicing means and said butt joints to reinforce the same.

8. The dock structure according to claim 1 in combination with means for fixing the position thereof in a body of water, said position fixing means comprising a hollow cylindrical tube, an upper mounting plate secured to said tube and having oppositely extending portions each having at least one pair of mounting holes that are spaced from one another by an amount corresponding to the space between transversely aligned web holes in said C-shaped members, a plurality of fasteners extending through the mounting holes and the web holes for securing said upper mounting plate to one of said side members, a lower mounting bracket secured to said tube below said upper mounting bracket and having oppositely extending portions that are substantially coplanar with said upper mounting bracket, first and second brace arms having lower ends secured to respective portions of said lower bracket and upper ends defining two mounting holes therein, last said mounting holes being spaced from one another by an amount greater than the spacing between opposite web holes in said C-shaped members so that said mounting holes can be positioned in registry with a web hole in said first row and with a web hole in said second row that is spaced along said side members from first said hole, and means extending through the registered holes to secure the upper ends of the brace to said side members, so that an elongate member can be introduced through said tubular member for penetration of the bottom below the body of water.

9. A method for fabricating a floating dock structure of the type having a walkway to be supported above the surface of a body of water and comprising the steps of providing a plurality of rigid structural members each having an identical generally C-shaped cross sectional shape formed by a web having opposite parallel edges and an integral flange extending perpendicularly from each of the edges, forming first and second rows of web holes in the webs in uniform spaced relation with the rows symmetrical of the center line of the web and with individual holes in each of the rows transversely aligned with each other, forming in each of the flanges a row of uniformly spaced apart flange holes with individual holes in one flange being transversely aligned with individual holes in the other flange, supporting a first one of the C-shaped structural members on a horizontal surface so that the flanges extend upward from the web, placing at least second and third C-shaped structural members on the first member in upstanding relation thereto with the flanges of the first member and the flanges of the second and third members in coplanar relationship, providing first and second gusset plates each of which has two mutually perpendicular rows of mounting holes that are spaced from one another by a distance equivalent to that between the flange holes in the C-shaped structural members, fastening the gussets between the first member and the second and third members by registering the mounting holes with the flange holes and installing fasteners in the registered holes, placing a fourth C-shaped structural member on the upper ends of the second and third members with the flanges in coplanar relation, providing third and fourth gussets substantially identical to the first and second gussets, and fastening the third and fourth gussets at the intersection of the fourth member and the second and third members by registering the gusset mounting holes with the flange holes and installing fasteners through the registered holes and fastening a rigid plate over said fastened C-shape structural members to form a walkway surface.

10. The method of claim 9 including the steps of fastening a buoyant body to the gussets which buoyant body has a width substantially equal to the length of the second and third members.

11. A method according to claim 10 wherein said buoyant body fastening step includes the steps of forming a hole in each of the gusset plates, passing a rod through the gusset plate holes and the buoyant body, and fixing the rod to the gusset plate and to the buoyant float.

12. A method according to claim 9 wherein each said gusset fastening step includes the steps of providing a plurality of temporary fasteners and a plurality of screws, first installing temporary fasteners in at least one but less than all registered holes of each row of registered gusset mounting holes and flange holes, next installing screws in at least some of the remaining registered holes, and then removing the temporary fasteners.

* * * * *